US009429322B2

(12) United States Patent
Doi et al.

(10) Patent No.: US 9,429,322 B2
(45) Date of Patent: Aug. 30, 2016

(54) GLOW PLUG

(75) Inventors: Yuki Doi, Komaki (JP); Shunsuke Goto, Nagoya (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 278 days.

(21) Appl. No.: 13/983,162

(22) PCT Filed: Apr. 12, 2012

(86) PCT No.: PCT/JP2012/002532
§ 371 (c)(1),
(2), (4) Date: Aug. 1, 2013

(87) PCT Pub. No.: WO2012/140892
PCT Pub. Date: Oct. 18, 2012

(65) Prior Publication Data

US 2013/0306017 A1 Nov. 21, 2013

(30) Foreign Application Priority Data

Apr. 15, 2011 (JP) ..... 2011-091096
Apr. 15, 2011 (JP) ..... 2011-091264

(51) Int. Cl.
*F23Q 7/00* (2006.01)
*H01T 13/08* (2006.01)

(52) U.S. Cl.
CPC ..... *F23Q 7/001* (2013.01); *H01T 13/08* (2013.01)

(58) Field of Classification Search
CPC ..... F23Q 7/001; F23Q 7/00; F23Q 7/22; F23Q 2007/004; F16L 19/106; F16L 5/08; F02F 1/242; H01T 13/02; H01T 13/00; H01T 13/08
See application file for complete search history.

(56) References Cited

U.S. PATENT DOCUMENTS 4,736,967 A * 4/1988 Mott et al. ..... 285/94
7,108,288 B2 9/2006 Bennett et al.
(Continued)

FOREIGN PATENT DOCUMENTS

EP 1457736 A1 9/2004
EP 1460404 A1 9/2004
(Continued)

OTHER PUBLICATIONS

International Search Report for PCT/JP2012/002532, dated May 22, 2012.
(Continued)

*Primary Examiner* — Hung Q Nguyen
*Assistant Examiner* — Jacob Amick
(74) *Attorney, Agent, or Firm* — Sughrue Mion, PLLC

(57) ABSTRACT

A glow plug (1) including a metallic shell (2) having a forward end portion (20) having an outer peripheral surface whose diameter increases toward the rear end side with respect to the axial direction, the forward end portion (20) coming into contact with a seat surface (55) formed on an internal combustion engine (50). The outer peripheral surface of the forward end portion (20) includes a first, second and third contact surfaces (21), (22) and (23), respectively, which differ in imaginary line angle from one another, the imaginary line angle of each contact surface being an angle which is formed, as viewed on a cross section including an axis $C_1$, between two straight imaginary lines connecting inflection points of the contact surface at opposite ends of the contact surface. At least one of the contact surfaces is a curved surface which bulges outward.

10 Claims, 6 Drawing Sheets

(56) References Cited

U.S. PATENT DOCUMENTS

| | | | | |
|---|---|---|---|---|
| 2002/0130121 | A1 | 9/2002 | Taniguchi et al. | |
| 2003/0025331 | A1 | 2/2003 | Williams et al. | |
| 2004/0182145 | A1* | 9/2004 | Okazaki et al. | 73/119 R |
| 2007/0289370 | A1 | 12/2007 | Hirose et al. | |

FOREIGN PATENT DOCUMENTS

| | | | |
|---|---|---|---|
| JP | 10-221192 | A | 8/1998 |
| JP | 2002-276942 | A | 9/2002 |
| JP | 2006-153306 | A | 6/2006 |
| JP | 2008-002809 | A | 1/2008 |
| JP | 2010-181068 | A | 8/2010 |
| WO | 2010/134320 | A1 | 11/2010 |

OTHER PUBLICATIONS

Communication dated Nov. 20, 2015, issued by the European Patent Office in corresponding European Application No. 12771432.7.

* cited by examiner

GLOW PLUG

CROSS REFERENCE TO RELATED APPLICATIONS

This application is a National Stage of International Application No. PCT/JP2012/002532 filed Apr. 2, 2012, claiming priority based on Japanese Patent Application Nos. 2011091264, filed Apr. 15, 2011 and 2011091096, filed Apr. 15, 2011, the contents of all of which are incorporated herein by reference in their entirety.

TECHNICAL FIELD

The present invention relates to a glow plug which is attached to an internal combustion engine.

BACKGROUND ART

Conventionally, a glow plug, for example, has been used so as to assist startup of an internal combustion engine such as an automotive engine. Such a glow plug has a generally known structure in which a sheath heater or a ceramic heater is supported by a cylindrical tubular housing made of metal such that a forward end portion of the heater projects from the housing and a rear end portion of the heater is held within the housing (see, for example, Patent Documents 1 and 2).

The glow plug also has a thread (external thread) portion formed on the outer circumference of the housing. When the glow plug is attached to, for example, an automotive engine, the glow plug is inserted into an attachment hole (through-hole) formed in the engine head of the automotive engine, and the thread portion of the housing is brought into screw engagement with a thread (internal thread) portion formed on the inner circumference of the attachment hole, to thereby fix the glow plug.

The glow plug also has a tapered surface which is formed on the outer circumferential surface of a forward end portion of the housing such that the diameter at the rear end thereof is greater than that at the forward end thereof. Meanwhile, the attachment hole of the engine head has a seat surface with which the tapered surface comes into contact. The airtightness between the internal combustion engine and the glow plug is maintained by bringing the tapered surface into contact with the seat surface.

PRIOR ART DOCUMENTS

Patent Documents

Patent Document 1: Japanese Patent Application Laid-Open (kokai) No. 2006-153306

Patent Document 2: Japanese Patent Application Laid-Open (kokai) No. 2010-181068

SUMMARY OF THE INVENTION

Problem to be Solved by the Invention

Incidentally, in the case of a presently used automotive engine, the angle of the seat surface of the attachment hole used for attaching a glow plug is set to one of different seat surface angles (e.g., 60°, 90°, and 120°) in accordance with the type of an automotive engine to which the glow plug is to be attached. Therefore, the angle of the tapered surface of each glow plug must be set in accordance with the angle of the seat surface of an automotive engine to which the glow plug is attached. Namely, there have been required a plurality of types of glow plugs having different taper angles corresponding to the different seat surface angles.

However, in order to prepare a plurality of types of glow plugs, it is necessary to prepare a plurality of types of housings which differ in the taper angle of the tapered surface and whose manufacture requires various jigs, etc. (namely, parts and jigs cannot be commonly used among the plurality of types of glow plugs). Also, if a glow plug having a tapered surface which does not match the seat surface of an internal combustion engine is erroneously attached to the engine, the airtightness between the internal combustion engine and the glow plug cannot be maintained.

The present invention has been accomplished in order to cope with the above-described conventional problem. An object of the present invention is to provide a glow plug which can be attached to a plurality of types of internal combustion engines that differ from one another in terms of the taper angle of the seat surface of each attachment hole, which can be manufactured from a housing of a single type without preparing a plurality of types of housings, and which allows common use of components.

Means for Solving the Problem

One mode of a glow plug of the present invention is a glow plug which comprises a tubular housing extending in a direction of an axis; and a rod-shaped heater whose forward end portion projects from a forward end of the housing and whose rear end portion is held inside the housing, characterized in that the housing has a forward end portion having an outer peripheral surface whose diameter increases toward the rear end side with respect to the axial direction, the forward end portion coming into contact with a seat surface formed on an internal combustion engine when the glow plug is attached to a through-hole provided in the internal combustion engine; the outer peripheral surface of the forward end portion includes a plurality of contact surfaces which differ in imaginary line angle from one another, the imaginary line angle of each contact surface being an angle which is formed, as viewed on a cross section including the axis, between two straight imaginary lines connecting inflection points of the contact surface at opposite ends of the contact surface; and at least one of the plurality of contact surfaces is a curved surface which bulges outward.

In the glow plug of the present invention, the outer peripheral surface of the forward end portion of the housing includes a plurality of contact surfaces which differ in imaginary line angle from one another, the imaginary line angle of each contact surface being an angle which is formed, as viewed on a cross section including the axis, between two straight imaginary lines connecting inflection points of the contact surface at opposite ends of the contact surface. As a result, even in the case where a plurality of internal combustion engines have seat surfaces having different taper angles determined in accordance with the types of the engines, one of the plurality of contact surfaces provided on the forward end portion of the housing can be brought into the corresponding seat surface. Therefore, glow plugs of a single type can be attached to a plurality of types of internal combustion engines whose seat surfaces have different taper angles. As a result, only a housing of a single type is needed, preparation of various types of jigs, etc. becomes unnecessary, and common use of components becomes possible.

Notably, the term "contact surface" used in claims refers to a surface which is expected to come into contact with a seat surface. Namely, in the case where one contact surface is in contact with a seat surface of an internal combustion engine, other surfaces which are not in contact with the seat surface are also referred to as contact surfaces.

Also, an "angle which is formed between two straight imaginary lines connecting inflection points of the contact surface at opposite ends of the contact surface (hereinafter also referred to as the imaginary line angle of the contact surface)" is shown in FIG. 3. Specifically, on a longitudinal cross section of the housing including the forward end portion, straight imaginary lines $\alpha_1$ and $\alpha_2$ which connect two inflection points P1 and P2 of a contact surface at opposite ends thereof are extended toward the axis $C_1$. Thus, the two imaginary lines $\alpha_1$ and $\alpha_2$ intersect each other and form an angle therebetween. This angle is the imaginary line angle.

Further, the expression "the outer peripheral surface includes a plurality of contact surfaces" in claims means that three or more inflection points (including inflection points provided on the side surface of the housing and at the edge of the forward end surface thereof) are provided on the outer peripheral surface of the housing, and two ore more imaginary lines can be drawn.

In addition, at least one of the plurality of contact surfaces is a curved surface which bulges outward. As a result, a stress which presses the seat surface concentrates at the apex of the curved surface of the contact surface which is in contact with the seat surface, whereby the airtightness between the internal combustion engine and the glow plug can be maintained reliably.

Notably, some of the plurality of contact surfaces may be curved surfaces bulging outward or all of the plurality of contact surfaces may be curved surfaces bulging outward.

Also, the term "curved surface" used in claims encompasses not only an arcuate surface which extends along a circle having a radius R as viewed on a cross section thereof, but also an arcuate surface which extends along an ellipse, a multi-dimensional curved surface, etc.

Moreover, the number of the contact surfaces formed on the forward end portion and the imaginary line angles of the contact surfaces may be freely set in accordance with the taper angles of the seat surfaces of a plurality of types of internal combustion engines to which a predetermined glow plug can be attached. The "taper angle of the seat surface" is defined as follow. As shown in FIG. 5, on a longitudinal cross section of the housing which includes the seat surface, two imaginary lines $\alpha_7$ and $\alpha_8$ extending along the seat surface at the opposite sides thereof are extended toward the axis $C_2$. Thus, the two imaginary lines $\alpha_7$ and $\alpha_8$ intersect each other and form an angle $\theta_4$ therebetween. This angle $\theta_4$ is the taper angle of the seat surface.

Notably, in the case where the imaginary line angle of a contact surface is equal to the taper angle of the seat surface, the seat surface can easily follow the contact surface. However, the imaginary line angle of the contact surface may be freely set to fall within a range of +5° in relation to the taper angle of the seat surface. In this case, the contact surface comes into contact with the seat surface, starting from the outer side thereof, and the seat surface follows the contact surface. As a result, the airtightness between the internal combustion engine and the glow plug can be maintained without fail.

In the glow plug of the present invention having the above-described structure, preferably, of the plurality of contact surfaces, a contact surface provided on the forward end side with respect to the axial direction has an imaginary line angle greater than that of a contact surface provided on the rear end side with respect to the axial direction. By virtue of this configuration, even when the glow plug has a plurality of contact surfaces which have different imaginary line angles, any of the contact surfaces can be brought into contact with the seat surface of the internal combustion engine.

In the glow plug of the present invention having the above-described structure, preferably, a contact surface provided on the forward end side with respect to the axial direction has a length in the axial direction shorter than that of a contact surface provided on the rear end side with respect to the axial direction. By virtue of this configuration, as compared with the case where the contact surface provided on the rear end side with respect to the axial direction has the same length in the axial direction as that of the contact surface provided on the forward end side with respect to the axial direction, the area of the contact surface on the rear end side which has a small imaginary line angle (which has steep imaginary lines) can be increased. As a result, the contact surface provided on the rear end side with respect to the axial direction and the contact surface provided on the forward end side with respect to the axial direction can be made substantially the same in terms of the stress which presses the seat surface, and even the contact surface provided on the rear end side with respect to the axial direction can maintain the airtightness between the internal combustion engine and the glow plug more reliably.

Moreover, in the glow plug of the present invention having the above-described structure, preferably, a curved contact surface is disposed in a region surrounded by the imaginary lines of the curved contact surface and the imaginary lines of two surfaces adjacent to the contact surface. By virtue of this configuration, the glow plug can be readily disposed in the through-hole of the internal combustion engine without receiving the influence of the curved contact surface. Notably, the expression "a curved contact surface is disposed in a region surrounded by the imaginary lines of the curved contact surface and the imaginary lines of two surfaces adjacent to the contact surface" means that, as shown in a lower left portion of FIG. 3, the entirety of the curved second contact surface is disposed in a region R surrounded by one imaginary line $\alpha_3$ of the second contact surface and the imaginary lines $\alpha_1$ and $\alpha_5$ of the first contact surface and the third contact surface adjacent to the second contact surface. Notably, in the case of a contact surface (e.g., the first contact surface and the third contact surface in FIG. 3) formed such that one of the two surfaces adjacent thereto is the side surface of the metallic shell or the forward end surface thereof, the region is specified by using an imaginary line extending along the side surface or the forward end surface of the metallic shell.

Another mode of the glow plug of the present invention is a glow plug which comprises a tubular housing extending in a direction of an axis; and a rod-shaped heater whose forward end portion projects from a forward end of the housing and whose rear end portion is held inside the housing, characterized in that the housing has a forward end portion having an outer peripheral surface whose diameter increases toward the rear end side with respect to the axial direction, the forward end portion coming into contact with a seat surface formed on an internal combustion engine when the glow plug is attached to a through-hole provided in the internal combustion engine; and the outer peripheral surface of the forward end portion includes a plurality of successively formed tapered surfaces which differ in taper angle from one another.

In the glow plug of the present invention, the outer peripheral surface of the forward end portion of the housing includes a plurality of successively formed tapered surfaces which differ in taper angle from one another. As a result, even in the case where a plurality of internal combustion engines have seat surfaces having different taper angles determined in accordance with the types of the engines, one of the plurality of tapered surfaces provided on the forward end portion of the housing can be brought into the corresponding seat surface. Therefore, glow plugs of a single type can be attached to a plurality of types of internal combustion engines whose seat surfaces have different taper angles. As a result, only a housing of a single type is needed, preparation of various types of jigs, etc. becomes unnecessary, and common use of components becomes possible.

Notably, the "taper angle of the tapered surfaces recited in claims is defined as follows. As shown in FIG. 7, on a longitudinal cross section of the housing including a tapered portion, two imaginary lines $\alpha_{21}$ and $\alpha_{22}$ extending along the tapered surface of the tapered portion at the opposite sides thereof are extended toward the axis $C_1$. Thus, the two imaginary lines $\alpha_{21}$ and $\alpha_{22}$ intersect each other and form an angle therebetween. This angle is the taper angle.

The taper angles of the tapered surfaces formed on the forward end portion and the number of the tapered surfaces may be freely set in accordance with the taper angles of the seat surfaces of a plurality of types of internal combustion engines to which a predetermined glow plug can be attached.

In the glow plug of the present invention having the above-described structure, preferably, one of the plurality of tapered surfaces can be brought into surface contact with the seat surface. By virtue of this configuration, irrespective of the type of the internal combustion engine, the tapered surface can be brought into surface contact with the seat surface, whereby the airtightness between the internal combustion engine and the glow plug can be maintained to a sufficient degree.

Notably, in the case where the taper angle of a tapered surface formed on the forward end portion is equal to the taper angle of a seat surface with which the tapered surface comes into surface contact, surface contact can be easily established between the tapered surface and the seat surface. However, the taper angle of the tapered surface may be freely set to fall within a range of +5° in relation to the taper angle of the seat surface. In this case, the tapered surface comes into contact with the seat surface, starting from the outer side thereof, and the seat surface follows the tapered surface, whereby a decrease in the area of surface contact can be prevented and surface contact can be realized.

In the glow plug of the present invention having the above-described structure, preferably, the outer peripheral surface of the forward end portion is formed such that a tapered surface provided on the forward end side with respect to the axial direction has a taper angle greater than that of a tapered surface provided on the rear end side with respect to the axial direction. By virtue of this configuration, even when the glow plug has a plurality of tapered surfaces which have different taper angles, any of the tapered surfaces can be brought into surface contact with the seat surface of the internal combustion engine. Notably, in the case where some tapered surfaces are formed such that the taper angle of the forward-end-side tapered surface becomes smaller than that of the rear-end-side tapered surface, the tapered surface having a smaller taper angle may fail to come into surface contact with the seat surface.

Also, in the glow plug of the present invention having the above-described structure, preferably, the outer peripheral surface of the forward end portion is formed such that a tapered surface provided on the forward end side with respect to the axial direction has a length in the axial direction shorter than that of a tapered surface provided on the rear end side with respect to the axial direction. By virtue of this configuration, as compared with the case where the plurality of tapered surfaces have the same length in the axial direction, the area of the tapered surface on the rear end side which has a small taper angle (which is steep) can be increased. As a result, even the tapered surface having a small taper angle can provide a reliable airtight seal in the same manner as in the case of the tapered surface on the forward end side which has a large taper angle.

EFFECTS OF THE INVENTION

According to the present invention, it is possible to provide a glow plug which can be attached to a plurality of types of internal combustion engines that differ from one another in terms of the taper angle of the seat surface of each attachment hole, which can be manufactured from a housing of a single type without preparing a plurality of types of housings, and which allows common use of components.

MODES FOR CARRYING OUT THE INVENTION

Embodiments of the present invention will now be described in detail with reference to the drawings.

Figure 1:
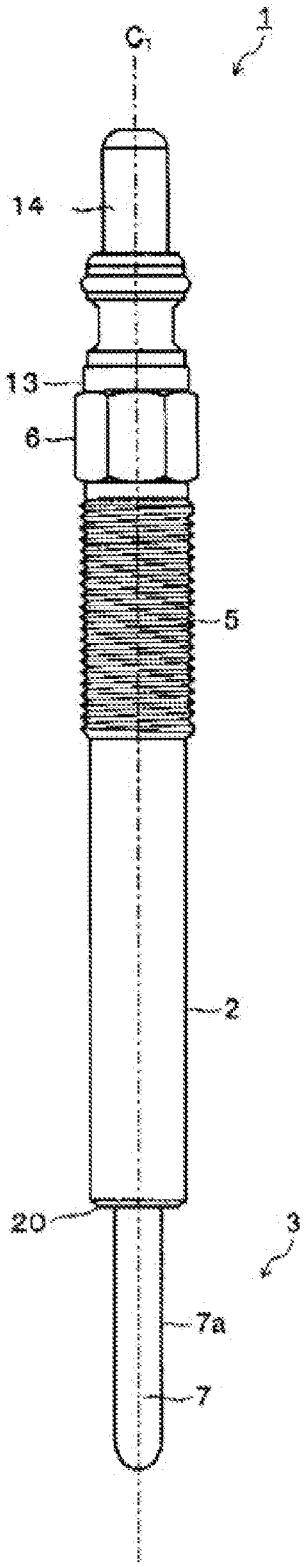
[FIG. 1] View schematically showing the structure of a glow plug according to a first embodiment of the present invention.
Figure 2:
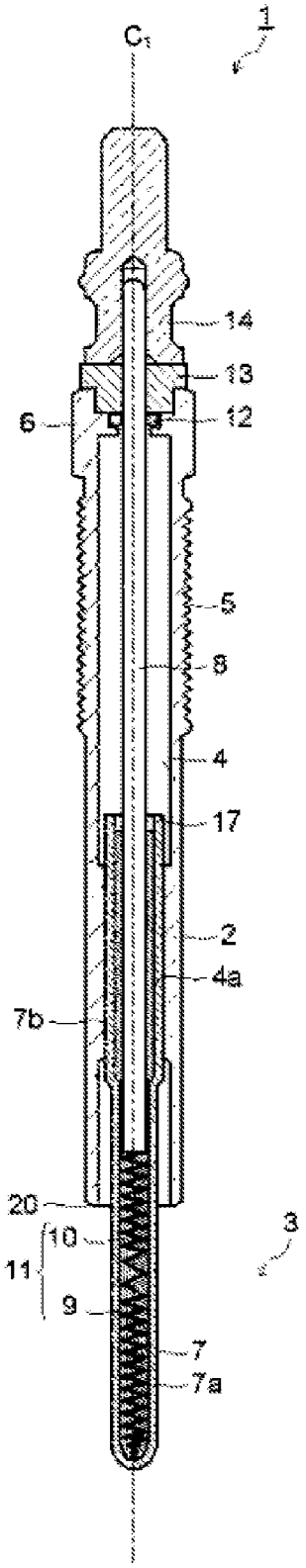
[FIG. 2] Sectional view schematically showing the structure of the glow plug according to the first embodiment of the present invention.

FIG. 1 is a view schematically showing the overall structure of a glow plug 1 according to a first embodiment of the present invention. FIG. 2 is a longitudinal sectional view schematically showing the structure of the glow plug 1.

As shown in FIGS. 1 and 2, the glow plug 1 includes a cylindrical tubular metallic shell (housing) 2 extending in the direction of an axis $C_1$, and a sheath heater 3 attached to the metallic shell 2. Notably, in FIGS. 1 and 2, a lower portion of the glow plug 1 on the sheath heater 3 side is a forward end portion which is inserted into an internal combustion engine, and an upper portion of the glow plug 1 in which a pin terminal 14 to be described later is provided is a rear end portion.

The metallic shell 2 is formed of iron and has an axial hole 4 which extends therethrough in the direction of the axis $C_1$. The metallic shell 2 has a thread portion 5 and a tool engagement portion 6 formed on the outer circumferential surface thereof. The thread portion 5 includes an external thread for attachment to a diesel engine. The tool engagement portion 6 has a hexagonal cross section, and a tool such as a torque wrench is engaged with the tool engagement portion 6. A forward end portion 20 of the metallic shell 2 is formed such that the diameter increases from the forward end side toward the rear end side. This forward end portion 20 is brought into contact with a seat surface 55 provided on an internal combustion engine 50 such as an automotive engine so as to provide an airtight seal therebetween. The configuration of this forward end portion 20 will be described in detail later. Notably, the metallic shell 2 corresponds to the "housing" recited in claims.

The sheath heater 3 includes a sheath tube 7 for accommodating a heating element 11. A center rod 8, which serves as a lead member, is fixed to a rear end portion of the sheath tube 7 for unification in the direction of the axis $C_1$.

The sheath tube 7, which is closed at the forward end thereof, is formed of metal, for example, a nickel alloy (e.g., INCONEL (product name). The heating element 11, which is composed of a heat generation coil 9 and a control coil 10, is accommodated within the sheath tube 7. Specifically, the heat generation coil 9 joined to the forward end of the sheath tube 7 and the control coil 10 connected in series to the rear end of the heat generation coil 9 are enclosed together with insulating powder such as magnesium oxide powder. The center rod 8 is joined to the rear end of the control coil 10, and an annular rubber member 17 provides a seal between the rear end of the sheath tube 7 and the center rod 8. Notably, in the present embodiment, the heat generation coil 9 is formed of an alloy which contains iron as a main component, and the control coil 10 is formed of an alloy which contains nickel as a main component.

The sheath tube 7 has a small diameter portion 7*a* which is formed at the forward end thereof and which accommodates the heat generation coil 9, etc., and a large diameter portion 7*b* which is formed rearward of the small diameter portion 7*a* and which has a diameter greater than that of the small diameter portion 7*a*. The small diameter portion 7*a* and the large diameter portion 7*b* are formed by swaging or the like. As shown in FIG. 2, this large diameter portion 7*b* is press-fitted into a small diameter portion 4*a* of the axial hole 4 of the metallic shell 2, whereby the sheath tube 7 is held in a state in which it projects from the forward end of the metallic shell 2.

The center rod 8 is a metal rod formed of an iron-based material (e.g., Fe—Cr—Mo steel). A forward end portion of the center rod 8 is inserted into the sheath tube 7 and is electrically connected to the rear end of the control coil 10. The center rod 8 extends through the axial hole 4 of the metallic shell 2. The rear end of the center rod 8 projects from the rear end of the metallic shell 2. An annular O-ring 12 and an insulating ring 13 formed of resin or the like are fitted onto a rear end portion of the center rod 8. The insulating ring 13 has a diameter increased portion at the rear end thereof, and is engaged with the rear end of the metallic shell 2 through the diameter increased portion.

The O-ring 12 is in contact with the inner circumferential surface of the axial hole 4 of the metallic shell 2, the outer circumferential surface of the center rod 8, and the forward end surface of the insulating ring 13 to thereby maintain the airtightness of the interior of the axial hole 4. The insulating ring 13 positions the center rod 8 within the axial hole 4 of the metallic shell 2 in a non-contact state, and electrically insulates the center rod 8 from the metallic shell 2.

The pin terminal 14 having the shape of a cap is fitted onto a rear end portion of the center rod 8 projecting from the rear end of the insulating ring 13. The center rod 8 and the pin terminal 14 constitute a connection terminal which is connected to the rear end of the sheath heater 3 (heating element).

The glow plug 1 having the above-described structure is assembled as follows. The sheath heater 3 is press-fitted into the axial hole 4 of the metallic shell 2. At the rear end of the metallic shell 2, the O-ring 12, the insulating ring 13, etc., are fitted onto the center rod 8. In a state in which the insulating ring 13 is pressed against the metallic shell 2, the outer periphery of the pin terminal 14 is crimped, whereby the glow plug 1 is completed.

Figure 3:
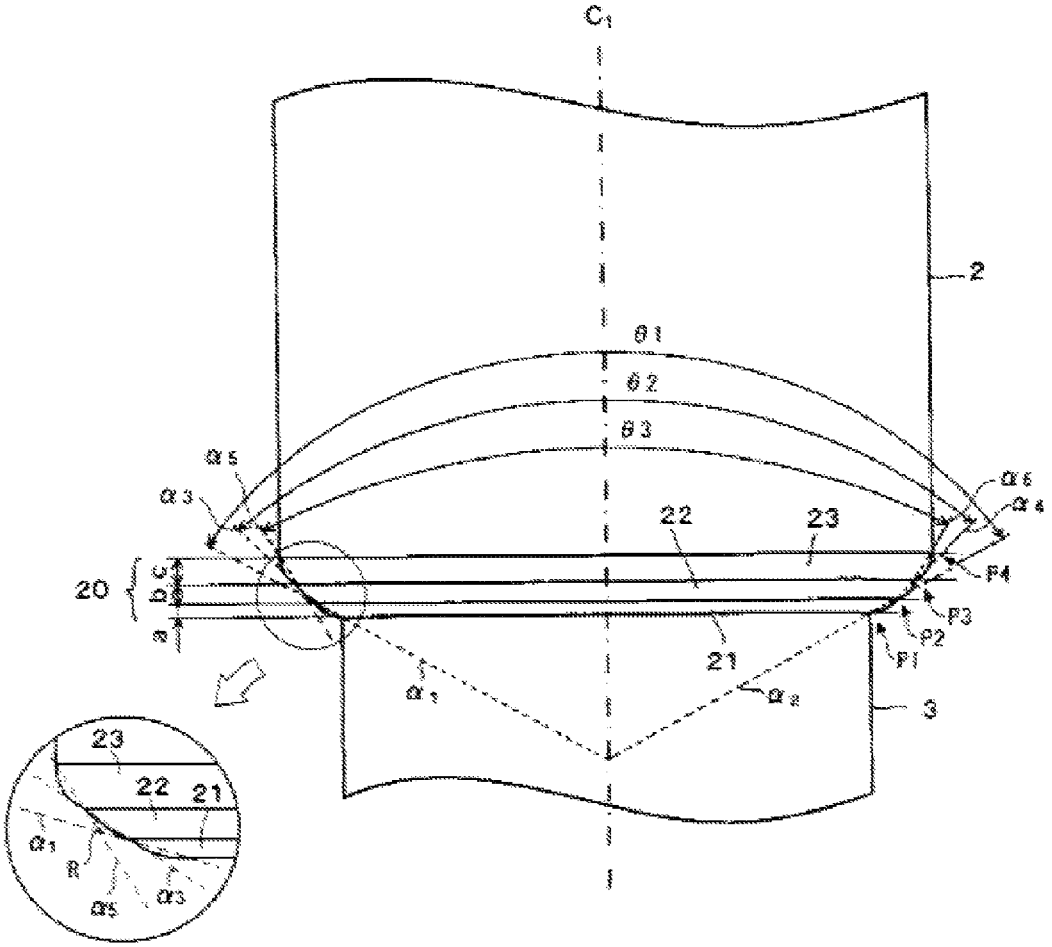
[FIG. 3] View showing, on an enlarged scale, the configuration of a main portion of the glow plug according to the first embodiment of the present invention.

Next, the forward end portion 20, which is the main feature of the present invention, will be described with reference to FIG. 3. FIG. 3 is a view showing, on an enlarged scale, the forward end portion 20 of the glow plug of FIG. 1.

As shown in FIG. 3, the outer circumferential surface of the forward end portion 20 of the metallic shell 2 includes three contact surfaces; i.e., a first contact surface 21, a second contact surface 22, and a third contact surface 23 formed in this sequence from the forward end side of the outer circumferential surface. The first contact surface 21 is a curved surface which is provided between a first inflection point P1 and a second inflection point P2 and which bulges outward (in the first embodiment, the curved surface has an arcuate cross section (see FIG. 3) having a curvature radius R of 0.5 mm). The second contact surface 22 is a curved surface which is provided between the second inflection point P2 and a third inflection point P3 and which bulges outward (in the first embodiment, the curved surface has an arcuate cross section having a curvature radius R of 3.7 mm). The third contact surface 23 is a curved surface which is provided between the third inflection point P3 and a fourth inflection point P4 and which bulges outward (in the first embodiment, the curved surface has an arcuate cross section having a curvature radius R of 0.5 mm).

The first contact surface 21, the second contact surface 22, and the third contact surface 23 differ from one another in terms of the angle between corresponding imaginary lines (hereafter referred to as the imaginary line angle). Specifically, the angle $\theta_1$ between first straight imaginary lines $\alpha_1$ and $\alpha_2$ which connect the first inflection point P1 and the second inflection point P2 at opposite ends of the first contact surface 21, the angle $\theta_2$ between second straight imaginary lines $\alpha_3$ and $\alpha_4$ which connect the second inflection point P2 and the third inflection point P3 at opposite ends of the second contact surface 22, and the angle $\theta_3$ between third straight imaginary lines $\alpha_5$ and $\alpha_6$ which connect the third inflection point P3 and the fourth inflection point P4 at opposite ends of the third contact surface 23 differ from one another. The angles $\theta_1$, $\theta_2$, and $\theta_3$ will be described with the angle $\theta_1$ of the first contact surface 21 taken as an example. As shown in FIG. 3, on a cross section of the metallic shell 2 taken along the axis thereof, the first imaginary lines $\alpha_1$ and $\alpha_2$ on opposite sides are extended toward the axis $C_1$. Thus, the two imaginary lines $\alpha_l$ and $\alpha_2$ intersect each other and form the angle $\theta_1$ therebetween. In the first embodiment, the angle $\theta_1$ is 123° , the angle $\theta_2$ is 93° , and the angle $\theta_3$ is 63° .

Figure 4:
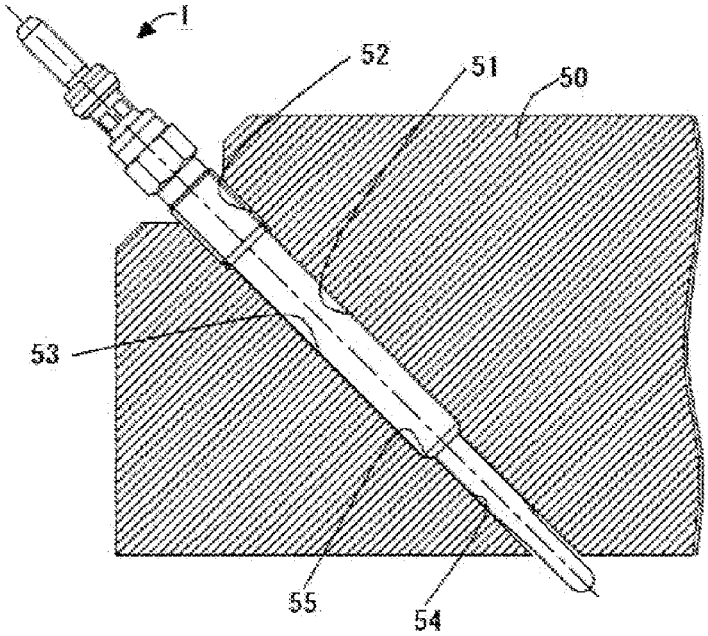
[FIG. 4] Sectional view showing a state in which the glow plug according to the first embodiment of the present invention is attached to an internal combustion engine.
Figure 5:
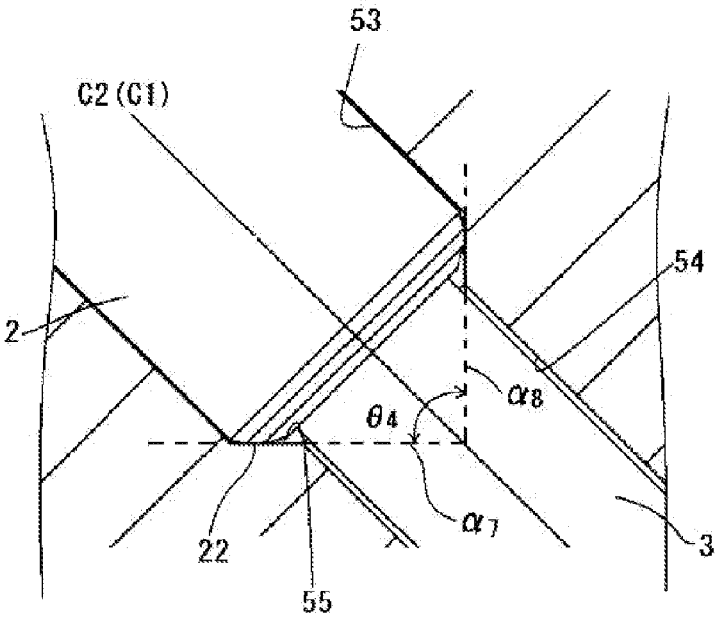
[FIG. 5] View showing, on an enlarged scale, the configurations of main portions of the glow plug and the internal combustion engine of FIG. 4.

Next, a state in which the glow plug 1 of the first embodiment is attached to an internal combustion engine 50 will be described with reference to FIGS. 4 and 5. FIG. 4 is a sectional view showing a state in which the glow plug 1 of FIG. 1 is attached to the internal combustion engine 50. FIG. 5 is a view showing, on an enlarged scale, the configurations of main portions of the glow plug 1 and the internal combustion engine 50.

The internal combustion engine 50 has an attachment hole 51 (through-hole) formed in an engine head (formed of aluminum). A thread (internal thread) portion 52 is provided on the wall surface of the attachment hole 51. When the glow plug 1 is inserted into the attachment hole 51, the thread portion 5 formed on the outer periphery of the housing 2 is brought into screw engagement with the thread portion 52, whereby the glow plug 1 is fixed to the internal combustion engine 50. Notably, the attachment hole 51 corresponds to the "through-hole" recited in claims.

The attachment hole 51 has a rear end hole section 53 having the thread portion 52, and a forward end hole section 54 which is located on the forward end side of the rear end hole section 53 and which has a reduced diameter compared with the rear end hole section 53. The forward end hole section 54 and the rear end hole section 53 are connected by a seat surface 55. The forward end portion 20 of the glow plug 1 is brought into contact with this seat surface 55, whereby the airtightness between the internal combustion engine 50 and the glow plug 1 is maintained.

Notably, in the first embodiment, the taper angle $\theta_4$ of the seat surface 55 is set to 90°. Here, the taper angle $\theta_4$ of the seat surface 55 is defined as follows. As shown in FIG. 5, on a longitudinal cross section of the housing which includes the seat surface 55, two imaginary lines $\alpha_7$ and $\alpha_8$ extending along the seat surface 55 at the opposite sides thereof are extended toward the axis $C_2$. Thus, the two imaginary lines $\alpha_7$ and $\alpha_8$ intersect each other and form an angle $\theta_4$ therebetween. This angle $\theta_4$ is the taper angle $\theta_4$ of the seat surface 55.

In the first embodiment, as shown in FIG. 5, of the contact surfaces provided on the forward end portion 20 of the metallic shell 2 of the glow plug 1, the second contact surface 22 is in contact with the seat surface 55 of the internal combustion engine 50. Specifically, the apex of the curved surface of the second contact surface 22 is in contact with the seat surface 55.

In FIG. 5, since the taper angle $\theta_4$ of the seat surface 55 is 90°, the seat surface 55 is in contact with the second contact surface 22 of the forward end portion 20. However, when the taper angle $\theta_4$ of the seat surface 55 of the internal combustion engine 50 is 60°, the third contact surface 23 comes into contact with the seat surface 55; and when the taper angle $\theta_4$ of the seat surface 55 of the internal combustion engine 50 is 120°, the first contact surface 21 comes into contact with the seat surface 55.

As described above, the glow plug 1 of the first embodiment has the first, second, and third contact surfaces 21, 22, and 23 which have different imaginary line angles $\theta_1$, $\theta_2$, and $\theta_3$. Therefore, when the glow plug 1 is attached to a plurality of internal combustion engines 50 which have seat surfaces 55 having different taper angles $\theta_4$ determined in accordance with the types of the engines, of the plurality of contact surfaces provided on the forward end portion 20 of the metallic shell 2 (i.e., the first contact surface 21, the second contact surface 22, and the third contact surface 23), one contact surface (the second contact surface 22 in FIG. 5) can be brought into contact with the seat surface 55. Therefore, the glow plug 1 of a single type can be attached to a plurality of types of internal combustion engines 50 whose seat surfaces 55 have different taper angles $\theta_4$. As a result, only one type of the metallic shell 2 is needed, preparation of various types of jigs, etc. becomes unnecessary, and common use of components becomes possible.

In addition, the plurality of contact surfaces (i.e., the first contact surface 21, the second contact surface 22, and the third contact surface 23) are curved surfaces which bulge outward. As a result, a stress which presses the seat surface 55 concentrates at the apex of the curved surface of the contact surface (the second contact surface 22 in FIG. 5) which is in contact with the seat surface 55, whereby the airtightness between the internal combustion engine 50 and the glow plug 1 can be maintained reliably.

Also, as described above, in the glow plug 1 of the first embodiment, the first, second, and third contact surfaces 21, 22, and 23 of the forward end portion 20 are disposed such that the imaginary line angle of the contact surface increases from the rear end side toward the forward end side ($\theta_1>\theta_2>\theta_3$). Thus, even when the glow plug 1 has a plurality of contact surfaces (i.e., the first contact surface 21, the second contact surface 22, and the third contact surface 23) which have different imaginary line angles $\theta_1$, $\theta_2$, and $\theta_3$, any of the first contact surface 21, the second contact surface 22, and the third contact surface 23 can be brought into surface contact with the seat surface 55 of the internal combustion engine 50.

Also, the forward end portion 20 is configured such that a contact surface located on the side toward the forward end of the metallic shell 2 is shorter in length in the direction of the axis $C_1$ of the metallic shell 2 than a contact surface located on the side toward the rear end of the metallic shell 2. Namely, the axial lengths a, b, and c of the first contact surface 21, the second contact surface 22, and the third contact surface 23 shown in FIG. 3 are determined such that the axial length b of the second contact surface 22 located forward of the third contact surface 23 is shorter than the axial length c of the third contact surface 23 located rearward of the second contact surface 22, and the axial length a of the first contact surface 21 located forward of the second contact surface 22 is shorter than the axial length b of the second contact surface 22 located rearward of the first contact surface 21. Namely, the axial lengths a, b, and c of the first contact surface 21, the second contact surface 22, and the third contact surface 23 are determined such that a relation $a<b<c$ is satisfied.

If the axial lengths a, b, and c are set such that $a=b=c$, the area of the contact surface decreases toward the rear-end-side contact surface which is small in the imaginary line angle. When the area of the contact surface is small, the stress which presses the seat surface 55 decreases, and the airtight seal between the internal combustion engine 50 and the glow plug 1 may become incomplete. In order to solve such a problem, as described above, the axial length of the rear-end-side third contact surface 23 which is small in the imaginary line angle is increased, whereby the rear-end-side third contact surface 23 which is small in the imaginary line angle can have a sufficiently large area. As a result, the stress which presses the seat surface 55 can be made the same as that in the case where the first contact surface 21 on the forward end side comes into contact with the seat surface 55.

Therefore, even when the third contact surface 23 on the rear end side comes into contact with the seat surface 55, the airtightness between the internal combustion engine 50 and the glow plug 1 can be maintained more reliably.

Also, as described above, in the glow plug 1 of the first embodiment, the first contact surface 21, the second contact surface 22, and the third contact surface 23 are preferably formed such that the difference in the imaginary line angle between adjacent contact surfaces is 40° or less. In the first embodiment, the difference between the imaginary line angle $\theta_1$ of the first contact surface 21 and the imaginary line angle $\theta_2$ of the second contact surface 22 is 30°, and the difference between the imaginary line angle $\theta_3$ of the third contact surface 23 and the imaginary line angle $\theta_2$ of the second contact surface 22 is 30°. As a result, irrespective of the type of the internal combustion engine 50, any of the first contact surface 21, the second contact surface 22, and the third contact surface 23 can be brought into contact with the seat surface 55, whereby the airtightness between the internal combustion engine 50 and the glow plug 1 can be maintained to a sufficient degree.

Furthermore, in the first embodiment, the imaginary line angle $\theta_2$ of the second contact surface 22 of the forward end portion 20 is 3° greater than the taper angle $\theta_4$ of the seat surface 55 with which the second contact surface 22 comes into contact. In the case where the imaginary line angle $\theta_2$ of the second contact surface 22 of the forward end portion 20 falls within a range of +5° in relation to the taper angle $\theta_4$ of the seat surface 55, the airtightness between the internal combustion engine 50 and the glow plug 1 can be maintained without fail. In this case, the second contact surface 22 comes into contact with the seat surface 55, starting from the outer side thereof, and the seat surface 55 follows the second contact surface 22. Thus, the airtightness between the internal combustion engine 50 and the glow plug 1 can be maintained without fail.

In particular, in the first embodiment, whereas the metallic shell 2 of the glow plug 1 which has the curved second contact surface is formed of iron, the internal combustion engine 50 having the seat surface 55 is formed of aluminum. Therefore, when the second contact surface 22 comes into contact with the seat surface 55, the seat surface 55 follows the curvature of the second contact surface 22, whereby surface contact may be established between the seat surface 55 and the second contact surface 22 in a certain region. Thus, the airtightness between the internal combustion engine 50 and the glow plug 1 can be maintained to a greater degree.

Moreover, in the first embodiment, the projection heights (the maximum lengths) of the first contact surface 21 and the third contact surface 23 as measured from their imaginary lines is greater than that of the second contact surface 22. This is because when the metallic shell 2 of the glow plug 1 is manufactured by forging (a method of easily manufacturing the metallic shell 2), the first contact surface 21 and the third contact surface 23 bulge further outward as compared with the second contact surface 22. Even when the forward end portion 20 is formed such that the projection height of the second contact surface 22 is smaller than those of the first contact surface 21 and the third contact surface 23, since these contact surfaces are curved, stress concentrates at the apex of a curved contact surface which comes into contact with the seat surface 55, whereby the airtightness between the internal combustion engine 50 and the glow plug 1 can be maintained to a sufficient degree.

Notably, the projection height of each curved contact surface refers to the length of the longest line which extends from one imaginary line of the curved contact surface to the curved contact surface in a direction perpendicular to the imaginary line. In the first embodiment, since each of the first contact surface 21, the second contact surface 22, and the third contact surface 23 is a curved surface having a radius R, the degree of bulging of each contact surface can be defined by the radius of curvature of each contact surface, rather than the projection height of each contact surface. Specifically, the radiuses of curvature of the first contact surface 21 and the third contact surface 23 are smaller than that of the second contact surface 22.

Moreover, in the first embodiment, as shown in a lower left portion of FIG. 3, the curved second contact surface 22 is disposed in a region R surrounded by the imaginary line $\alpha_3$ of the second contact surface 22 and the imaginary lines $\alpha_1$ and $\alpha_5$ of the first contact surface 21 and the third contact surface 23 adjacent to the second contact surface. As a result, the glow plug 1 can be readily disposed in the attachment hole 51 of the internal combustion engine 50 without receiving the influence of the second contact surface 22.

Figure 6:
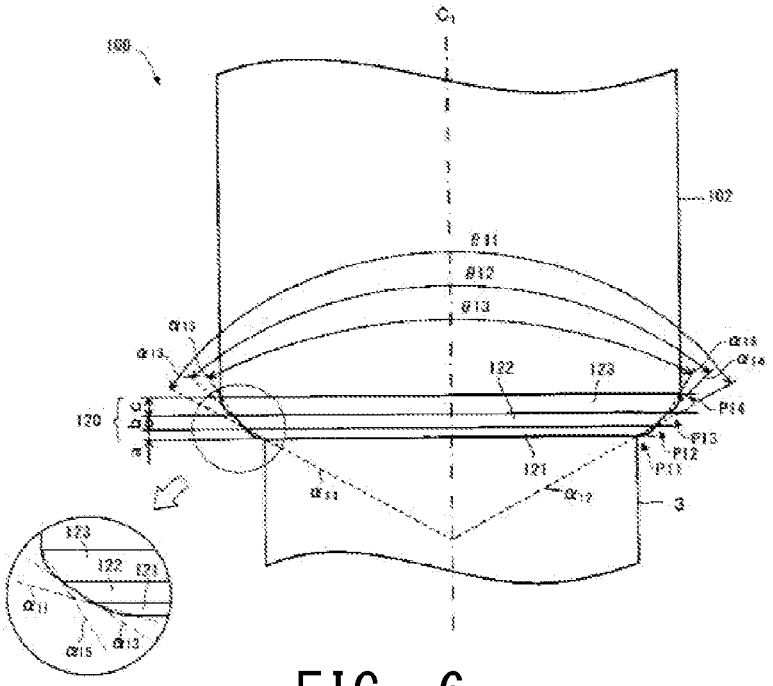
[FIG. 6] View showing, on an enlarged scale, the configuration of a main portion of a glow plug according to a modification of the first embodiment of the present invention.

Next, a glow plug 100 according to a modification of the first embodiment of the present invention will be described. FIG. 6 is a view showing, on an enlarged scale, the configuration of a main portion of the glow plug 100 according to the modification. Notably, the glow plug 100 of the modification has the same shape as the glow plug 1 of the first embodiment except the shape of the forward end portion of the metallic shell. Therefore, in the description of the glow plug 100 of the modification, the structural components, other than the metallic shell, which have the same shapes as those of the glow plug 1 of the first embodiment will be described by using the same reference numerals as those used in the first embodiment, or their descriptions will be simplified or omitted.

As shown in FIG. 6, three different contact surfaces; i.e., a first contact surface 121, a second contact surface 122, and a third contact surface 123, are formed on a forward end portion 120 of a metallic shell 102 in this sequence from the forward end side. Of these contact surfaces, the first contact surface 121 is a curved surface which is provided between a first inflection point P11 and a second inflection point P12 and which bulges outward (in the modification, the curved surface has an arcuate cross section (see FIG. 6) having a curvature radius R of 0.50mm). The third contact surface 122 is a curved surface which is provided between a third inflection point P13 and a fourth inflection point P14 and which bulges outward (in the modification, the curved surface has an arcuate cross section having a curvature radius R of 0.5 mm). In contrast, the second contact surface 122 is a substantially straight tapered surface which is provided between the second inflection point P12 and the third inflection point P13.

The first contact surface 121, the second contact surface 122, and the third contact surface 123 differ from one another in imaginary line angle. Specifically, the angle $\theta_{11}$ between first straight imaginary lines $\alpha_{11}$ and $\alpha_{12}$ which connect the first inflection point P11 and the second inflection point P12 at opposite ends of the first contact surface 121, the angle $\theta_{12}$ between second straight imaginary lines $\alpha_{13}$ and $\alpha_{14}$ which connect the second inflection point P12 and the third inflection point P13 at opposite ends of the second contact surface 122, and the angle $\theta_{13}$ between third straight imaginary lines $\alpha_{15}$ and $\alpha_{16}$ which connect the third inflection point P13 and the fourth inflection point P14 at opposite ends of the third contact surface 123 differ from one another. In the modification, the angle $\theta_{11}$ is 123°, the angle $\theta_{12}$ is 93°, and the angle $\theta_{13}$ is 63°.

As described above, the glow plug 100 of the modification has the first, second, and third contact surfaces 121, 122, and 123 which have different imaginary line angles $\theta_{11}$, $\theta_{12}$, and $\theta_{13}$. Therefore, when the glow plug 100 is attached to a plurality of internal combustion engines 50 which have seat surfaces 55 having different taper angles $\theta_4$ determined in accordance with the types of the engines, of the plurality of contact surfaces provided on the forward end portion 120 of a metallic shell 102 (i.e., the first contact surface 121, the second contact surface 122, and the third contact surface 123), one contact surface (the second contact surface 122 in FIG. 5) can be brought into contact with the seat surface 55. Therefore, the glow plug 100 of a single type can be attached to a plurality of types of internal combustion engines 50 whose seat surfaces 55 have different taper angles $\theta_4$. As a result, only one type of the metallic shell 102 is needed, preparation of various types of jigs, etc. becomes unnecessary, and common use of components becomes possible.

In addition, the plurality of contact surfaces; i.e., the first contact surface 121 and the third contact surface 123, are curved surfaces which bulge outward. As a result, a stress which presses the seat surface 55 concentrates at the apex of the curved surface of the contact surface which is in contact with the seat surface 55, whereby the airtightness between the internal combustion engine 50 and the glow plug 100 can be maintained reliably.

Also, in the case of the glow plug 100 of the modification, the second contact surface 122 provided between the first contact surface 121 and the third contact surface 123 is a tapered surface. This is because when the metallic shell 2 of the glow plug 100 is manufactured by forging (a method of easily manufacturing the metallic shell 2), the second contact surface remains as a tapered surface, although the first contact surface 121 and the third contact surface 123 bulge outward. Even when the second contact surface 122 provided between the first contact surface 121 and the third contact surface 123 is a tapered surface, since surface contact is established between the second contact surface 122 and the seat surface 55, the airtightness between the internal combustion engine 50 and the glow plug 100 can be maintained.

Figure 7:
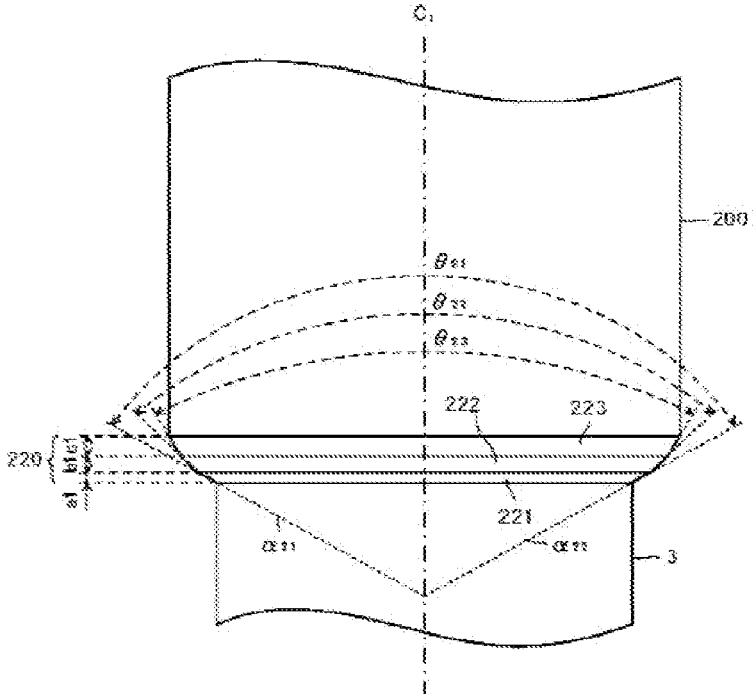
[FIG. 7] View showing, on an enlarged scale, the configuration of a main portion of a glow plug according to a second embodiment of the present invention.

Next, a glow plug 200 according to a second embodiment of the present invention will be described. FIG. 7 is a view showing, on an enlarged scale, the configuration of a main portion of the glow plug 200 according to the second embodiment. Notably, the glow plug 200 of the second embodiment has the same shape as the glow plug 1 of the first embodiment except the shape of the forward end portion of the metallic shell. Therefore, in the description of the glow plug 200 of the second embodiment, the structural components, other than the metallic shell, which have the same shapes as those of the glow plug 1 of the first embodiment, will be described by using the same reference numerals as those used in the first embodiment, or their descriptions will be simplified or omitted.

As shown in FIG. 7, the outer circumferential surface of a forward end portion 220 of a metallic shell 202 includes three tapered surfaces; i.e., a first tapered surface 221 having a taper angle $\theta_{21}$, a second tapered surface 222 having a taper angle $\theta_{22}$, and a third tapered surface 223 having a taper angle $\theta_{23}$, which are formed in this sequence from the forward end side of the outer circumferential surface. The taper angle of each tapered surface is defined as follows. As shown in FIG. 7, on a longitudinal cross section of the metallic shell 202 including the first tapered surface 221, the second tapered surface 222, and the third tapered surface 223, two imaginary lines $\alpha_{21}$ and $\alpha_{22}$ extending along, for example, the first tapered surface 221 at the opposite sides thereof are extended toward the axis $C_1$. Thus, the two imaginary lines $\alpha_{21}$ and $\alpha_{22}$ intersect each other and form an angle $\theta_{21}$ therebetween. This angle $\theta_{21}$ is the taper angle of the first tapered surface 221. The taper angle $\theta_{21}$ of the first tapered surface 221 shown in FIG. 7 is 123° in the second embodiment. Also, the taper angle $\theta_{22}$ of the second tapered surface 222 is 93° in the second embodiment, and the taper angle $\theta_{23}$ of the third tapered surface 223 is 63° in the second embodiment.

Figure 8:
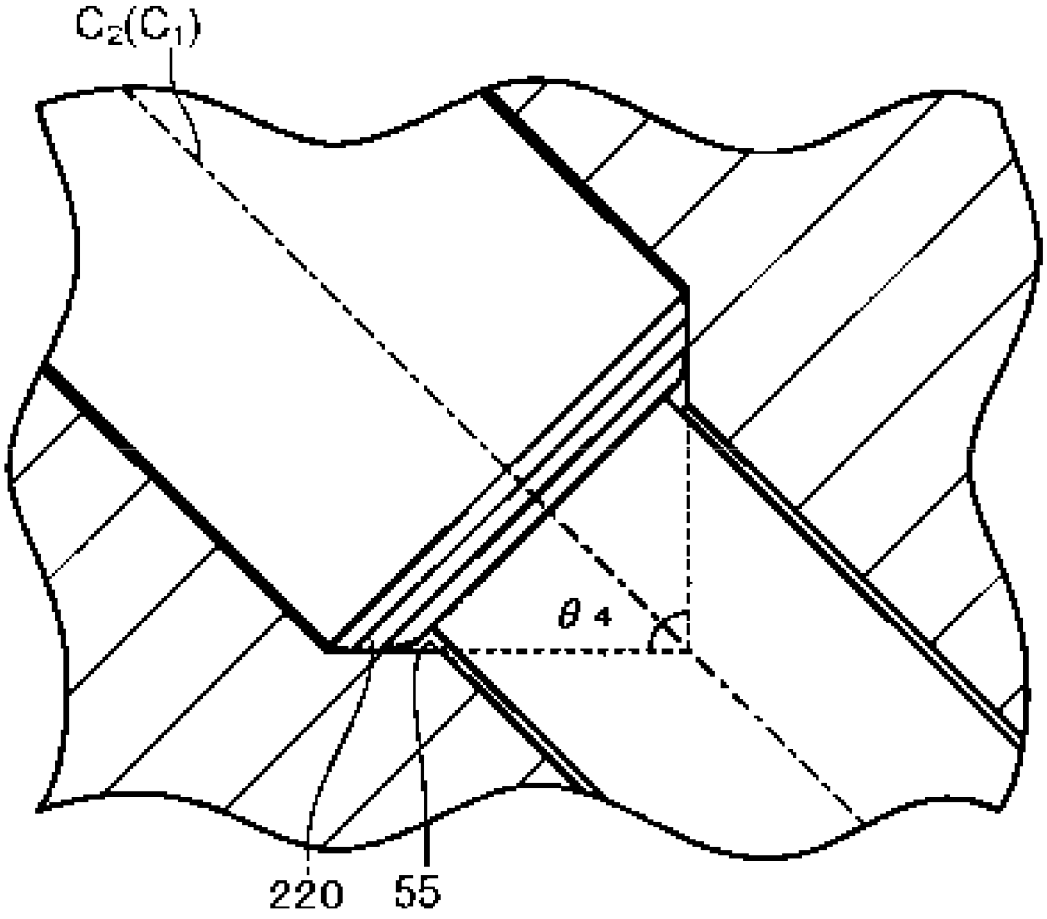
[FIG. 8] Sectional view showing a state in which the glow plug according to the second embodiment of the present invention is attached to an internal combustion engine.

Next, a state in which the glow plug 200 of the second embodiment is attached to an internal combustion engine 50 will be described with reference to FIG. 8. FIG. 8 is a view showing, on an enlarged scale, the configurations of main portions of the glow plug 200 and the internal combustion engine 50. Notably, the internal combustion engine 50 has the same shape as the internal combustion engine 50 of the first embodiment. Therefore, the internal combustion engine 50 will be described by using the same reference numerals as those used in the first embodiment, or its description will be simplified or omitted.

In the second embodiment, as shown in FIG. 8, of the tapered surfaces provided on the forward end portion 220 of the metallic shell 202 of the glow plug 200, the second tapered surface 222 is in contact with the seat surface 55 of the internal combustion engine 50. In FIG. 8, since the taper angle $\theta_4$ of the seat surface 55 is 90°, the seat surface 55 is in surface contact with the second tapered surface 222 of the forward end portion 220. However, when the taper angle $\theta_4$ of the seat surface 55 of the internal combustion engine 50 is 60°, the third tapered surface 223 comes into surface contact with the seat surface 55; and when the taper angle $\theta_4$ of the seat surface 55 of the internal combustion engine 50 is 120°, the first tapered surface 221 comes into surface contact with the seat surface 55.

As described above, the glow plug 200 of the second embodiment has the first, second, and third tapered surfaces 221, 222, and 223 which have different taper angles $\theta_{21}$, $\theta_{22}$, and $\theta_{23}$. Therefore, when the glow plug 200 is attached to a plurality of internal combustion engines 50 which have seat surfaces 55 having different taper angles $\theta_4$ determined in accordance with the types of the engines, of the plurality of tapered surfaces provided on the forward end portion 220 of the metallic shell 202 (i.e., the first tapered surface 221, the second tapered surface 222, and the third tapered surface 223), one tapered surface (the second tapered surface 222 in FIG. 5) can be brought into contact with the seat surface 55. The glow plug 1 of a single type can be attached to a plurality of types of internal combustion engines 50 whose seat surfaces 55 have different taper angles $\theta_4$. As a result, only one type of the metallic shell 202 is needed, preparation of various types of jigs, etc. becomes unnecessary, and common use of components becomes possible.

Furthermore, as described above, in the glow plug 200 of the second embodiment, the second tapered surface 222 is in surface contact with the seat surface 55. As a result, irrespective of the type of the internal combustion engine 50, the second tapered surface 222 can be brought into surface contact with the seat surface 55, whereby the airtightness between the internal combustion engine 50 and the glow plug 200 can be maintained to a sufficient degree.

Also, as described above, in the glow plug 200 of the second embodiment, the first, second, and third tapered surfaces 221, 222, and 223 of the forward end portion 220 are formed such that the taper angle increases from the rear end side toward the forward end side ($\theta_{21}>\theta_{22}>\theta_{23}$). Thus, even when the glow plug 200 has a plurality of tapered surfaces (i.e., the first tapered surface 221, the second tapered surface 222, and the third tapered surface 223) which have different taper angles $\theta_{21}$, $\theta_{22}$, and $\theta_{23}$, any of the first tapered surface 221, the second tapered surface 222, and the third tapered surface 223 can be brought into surface contact with the seat surface 55 of the internal combustion engine 50.

Also, the outer peripheral surface of the forward end portion 220 is configured such that a tapered surface located on the side toward the forward end of the metallic shell 202 is shorter in length in the direction of the axis $C_1$ of the metallic shell 202 than a tapered surface located on the side toward the rear end of the metallic shell 202. Namely, the axial lengths (lengths in the direction of the axis C1) a1, b1, and c1 of the first tapered surface 221, the second tapered surface 222, and the third tapered surface 223 shown in FIG. 7 are determined such that the axial length b1 of the second tapered surface 222 located forward of the third tapered surface 223 is shorter than the axial length c1 of the third tapered surface 223 located rearward of the second tapered surface 222, and the axial length a1 of the first tapered surface 221 located forward of the second tapered surface 222 is shorter than the axial length b1 of the second tapered surface 222 located rearward of the first tapered surface 221. Namely, the axial lengths a1, b1, and c1 of the first tapered surface 221, the second tapered surface 222, and the third tapered surface 223 are determined such that a relation a1<b1<c1 is satisfied.

If the axial lengths a1, b1, and c1 are set such that al =bl =c1, the area of the tapered surface decreases toward the rear-end-side tapered surface which is small in the taper angle. When the area of the tapered surface is small, the airtight seal formed through establishment of surface contact may become incomplete. In order to solve such a problem, as described above, the axial length of the rear-end-side third tapered surface having a small taper angle is increased, whereby the rear-end-side third tapered surface 223 having a small taper angle can have a sufficiently large area. As a result, even when the third tapered surface 223 having a small taper angle comes into contact with the seat surface 55, the airtight seal can be provided reliably as in the case where the first tapered surface 221 having a large taper angle comes into contact with the seat surface 55.

Also, as described above, in the glow plug 200 of the second embodiment, the first tapered surface 221, the second tapered surface 222, and the third tapered surface 223 are preferably formed such that the difference in the taper angle between adjacent tapered surfaces is 40° or less. In the present embodiment, the difference between the taper angle $\theta_{21}$ of the first tapered surface 221 and the taper angle $\theta_{22}$ of the second tapered surface 222 is 30°, and the difference between the taper angle $\theta_{23}$ of the third tapered surface 223 and the taper angle $\theta_{22}$ of the second tapered surface 222 is 30°. As a result, irrespective of the type of the internal combustion engine 50, the forward end portion 220 can be brought into surface contact with the seat surface 55, whereby the airtightness between the internal combustion engine 50 and the glow plug 1 can be maintained to a sufficient degree.

Furthermore, in the second embodiment, the taper angle $\theta_{22}$ of the second tapered surface 222 of the forward end portion 220 is 3° greater than the taper angle $\theta_4$ of the seat surface 55 with which the second tapered surface 222 comes into contact. In the case where the imaginary line angle $\theta_{22}$ of the second tapered surface 222 of the forward end portion 220 falls within a range of +5° in relation to the taper angle $\theta_4$ of the seat surface 55, a decrease in the area of surface contact can be prevented. Namely, in this case, the second tapered surface 222 comes into contact with the seat surface 55, starting from the outer side thereof, and the seat surface 55 follows the second tapered surface 222. Thus, a decrease in the area of surface contact can be prevented.

Although the present invention has been described on the basis of embodiments thereof, the invention is not limited to the embodiments and various modifications are possible.

In the first embodiment, the second embodiment, and the modification, the imaginary line angles $\theta_1$ and $\theta_{11}$ are 123°, the imaginary line angles $\theta_2$ and $\theta_{12}$ are 93°, and the imaginary line angles $\theta_3$ and $\theta_{13}$ are 63°. However, the imaginary line angles are not limited thereto, and the imaginary line angles of the contact surfaces and the number of the contact surfaces may be freely set in accordance with the taper angles $\theta_4$ of the seat surfaces 55 of a plurality of types of internal combustion engines 50.

Notably, in the case where, as in the first embodiment, the second embodiment, and the modification, the forward end portion 20 has three contact or tapered surfaces (i.e., the first contact surface 21, 121 or the first tapered surface 221, the second contact surface 22, 122 or the second tapered surface 222, and the third contact surface 23, 123 or the third tapered surface 223), preferably, the imaginary line angles or the taper angles are determined such that $\theta_1$, $\theta_{11}$, $\theta_{21}$: 130° to 110°, $\theta_2$, $\theta_{12}$, $\theta_{22}$: 100° to 80°, and $\theta_3$, $\theta_{13}$, $\theta_{23}$: 70° to 50°.

Also, the first contact surface 21, the second contact surface 22, the third contact surface 23 of the first embodiment and the first contact surface 121 and the third contact surface 123 of the modification are arcuate surfaces each of which extends along a circle having a radius R. However, the shape of the contact surfaces is not limited thereto, and each of the contact surfaces may be an arcuate surface which extends along an ellipse, a multi-dimensional curved surface, etc.

In the first embodiment, the second embodiment, and the modification, the present invention is applied to a metal glow plug which uses a sheath heater. However, the present invention can be similarly applied to a ceramic glow plug which uses a ceramic heater.

DESCRIPTION OF REFERENCE NUMERALS

1, 100, 200 . . . glow plug; 2, 102, 202 . . . metallic shell; 3 . . . sheath heater; 7 . . . sheath tube; 13 . . . insulator; 14 . . . pin terminal; 20, 120 . . . forward end portion; 21, 121 . . . first contact surface; 22, 122 . . . second contact surface; 23, 123 . . . third contact surface; 221 . . . first tapered surface; 222 . . . second tapered surface; 223 . . . third tapered surface; 50 . . . internal combustion engine; 55 . . . seat surface

The invention claimed is:

1. A glow plug comprising:

a tubular housing extending in a direction of an axis; and a rod-shaped heater whose forward end portion projects from a forward end of the housing and whose rear end portion is held inside the housing, characterized in that the housing has a forward end portion having an outer peripheral surface whose diameter increases toward the rear end side with respect to the axial direction, the forward end portion coming into contact with a seat surface formed on an internal combustion engine when the glow plug is attached to a through-hole provided in the internal combustion engine;

the outer peripheral surface of the forward end portion includes a plurality of contact surfaces which differ in imaginary line angle from one another, the imaginary line angle of each contact surface being an angle which is formed, as viewed on a cross section including the axis, between two straight imaginary lines connecting inflection points of the contact surface at opposite ends of the contact surface; and at least one of the plurality of contact surfaces is a curved surface which bulges outward, wherein in the plurality of contact surfaces, an imaginary line angle of contact surface provided on the most forward end side with respect to the axial direction is 130° to 110°, and an imaginary line angle of contact surface provided on the most rear end side with respect to the axial direction is 70° to 50°.

2. A glow plug according to claim 1, wherein, of the plurality of contact surfaces, a contact surface provided on the forward end side with respect to the axial direction has an imaginary line angle greater than that of a contact surface provided on the rear end side with respect to the axial direction.

3. A glow plug according to claim 1, wherein a contact surface provided on the forward end side with respect to the axial direction has a length in the axial direction shorter than that of a contact surface provided on the rear end side with respect to the axial direction.

4. A glow plug according to claim 1, wherein a curved contact surface is disposed in a region surrounded by the imaginary lines of the curved contact surface and the imaginary lines of two surfaces adjacent to the contact surface.

5. A glow plug comprising:

a tubular housing extending in a direction of an axis; and a rod-shaped heater whose forward end portion projects from a forward end of the housing and whose rear end portion is held inside the housing, characterized in that the housing has a forward end portion having an outer peripheral surface whose diameter increases toward the rear end side with respect to the axial direction, the forward end portion coming into contact with a seat surface formed on an internal combustion engine when the glow plug is attached to a through-hole provided in the internal combustion engine; and the outer peripheral surface of the forward end portion includes a plurality of successively formed tapered surfaces which differ in taper angle from one another, wherein in the plurality of contact surfaces, an imaginary line angle of contact surface provided on the most forward end side with respect to the axial direction is 130° to 110°, and an imaginary line angle of contact surface provided on the most rear end side with respect to the axial direction is 70° to 50°.

6. A glow plug according to claim 5, wherein one of the plurality of tapered surfaces can be brought into surface contact with the seat surface.

7. A glow plug according to claim 5, wherein the outer peripheral surface of the forward end portion is formed such that a tapered surface provided on the forward end side with respect to the axial direction has a taper angle greater than that of a tapered surface provided on the rear end side with respect to the axial direction.

8. A glow plug according to claim 7, wherein the outer peripheral surface of the forward end portion is formed such that a tapered surface provided on the forward end side has a length in the axial direction shorter than that of a tapered surface provided on the rear end side.

9. A glow plug according to claim 1, wherein the glow plug is adapted for fixing to an attachment hole of any of a plurality of internal combustion engines, the attachment holes of individual ones of the internal combustion engines each having a seat surface differing in taper angle, and one or more of the contact surfaces of the glow plug coming into contact with the seat surface when the glow plug is fixed to the attachment hole of individual ones of the internal combustion engines.

10. A glow plug according to claim 5, wherein the glow plug is adapted for fixing to an attachment hole of any of a plurality of internal combustion engines, the attachment holes of individual ones of the internal combustion engines each having a seat surface differing in taper angle, and one or more of the plurality of successively formed tapered surfaces which differ in taper angle from one another of the glow plug coming into contact with the seat surface when the glow plug is fixed to the attachment hole of individual ones of the internal combustion engines.

* * * * *